United States Patent [19]

Larson et al.

[11] 4,266,631

[45] May 12, 1981

[54] EXTENSION LADDERS WITH ROTARY HOOK LOCKS

[75] Inventors: Clayton E. Larson, Brooklyn, N.Y.; Edward H. Lemp, Bellows Falls, Vt.

[73] Assignee: White Metal Rolling & Stamping Corp., Brooklyn, N.Y.

[21] Appl. No.: 133,983

[22] Filed: Mar. 26, 1980

[51] Int. Cl.[3] ..... E06C 7/06

[52] U.S. Cl. ..... 182/211

[58] Field of Search ..... 182/207, 208, 209, 210, 182/211, 212, 213

[56] References Cited

U.S. PATENT DOCUMENTS 3,502,175 3/1970 Bullock ..... 182/211

*Primary Examiner*—Reinaldo P. Machado

*Attorney, Agent, or Firm*—Carroll F. Palmer

[57] ABSTRACT

Extension ladders having a bed section and a fly section comprises automatic hook locks of a rotary type that rotate on shafts carried on brackets parallel to the side rails of the ladder fly section to move between normal hooking positions and intermittent passing positions. Pivoted toggles rotate with the hook locks and serve to move them into their passing position as the fly section is lowered. The hook portions of the locks are contoured to move them into their passing position by contact with step members of the bed section as the fly section is raised.

7 Claims, 11 Drawing Figures

EXTENSION LADDERS WITH ROTARY HOOK LOCKS

BACKGROUND OF THE INVENTION

1. Field of the Invention

This invention relates to extension ladders. More particularly, it concerns extension ladders with automatic hook locks of the rotary type for adjustment of the length of the ladders.

2. Description of the Prior Art

It is conventional practice in the manufacture of extension ladders to use automatic hook locks to enable the position of the fly section of the ladder to be adjusted relative to the bed section. Such hook locks are most frequently of the (a) tension type or the (b) gravity type.

The tension type hook locks can be made quite compact and durable, but they are conventionally installed on the fly section with the omission of a rung in the bed section to provide space for the hook locks to operate. The omission of the rung can be avoided (see U.S. Pat. No. 968,040 and 1,457,100), but this involves specialized hooks that limit movement of the hook locks.

The gravity type hook locks are conventionally used without having a skipped rung in the fly section. Hence, they avoid the safety hazard created by the absence of the rung, but the locks of this type are excessively large and they present durability and maintenance problems.

A third variety of hook locks are the rotary type (see U.S. Pat. No. 3,507,175) which do not require the ladders to have a skipped rung. Also, they can be made more compact and are more reliable in operation than the gravity type locks. This invention concerns new improvements in the construction of this type of hook locks for extension ladders.

OBJECTS

A principal object of this invention is the provision of extension ladders having automatic hook locks which do not require there be a skipped rung in the fly section.

Another object is the provision of new, improved forms of rotary hook locks for extension ladders.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of extension ladders having a bed section and a fly section and which comprise new, improved automatic hook locks of the rotary type that move between a normal locking position and an intermittent passing position.

Each ladder has a pair of identical rotary hook locks and each hook lock comprises a rotatable hook unit having an elongated tubular member with a contoured hook portion extending laterally therefrom. A longitudinal shaft is fixed apart from and parallel to a side rail of the ladder's fly section by a pair of brackets fastened to the side rail and the hook unit is rotatably carried on the shaft between the brackets.

Each rotary hook lock also has spring means to bias the lock into its hooking position, but permit it to swing into the passing position as the fly section is raised or lowered.

Each lock further includes a lug member that serves to limit extent of its rotation and also to carry a pivoted toggle that is spring biased to normally cover the outboard end of the hook portion of the rotary lock. These pivoted toggles rotate with the hook locks and serve to move them into their passing position as the fly section is lowered.

The hook portions of the rotary hook locks are contoured to move them into their passing position by contact with step members of the bed section as the fly section is raised. During a part of such upward movement of the fly section, the lock toggles will be moved by a passing rung of the bed section so the locks will rotate into locking position with the toggles depressed and, hence, inactivated so the hook portion bears on a rung of the bed section fixing the ladder at the extended length desired by the ladder user.

Key factors of the new rotary hook locks involve an integral hook and vertical axis member with a round interior for rotating on a vertical shaft, and a square exterior which acts as a key or lock to achieve rotation of the bracket holding the toggle. This unique bracket, in turn, provides an offset to initiate rotation when downward pressure is exerted by the sliding surface of the toggle. The hook member is a cut section from an original extrusion providing integral union of the hook and the vertical axis and the manner in which it is bracketed provides space for a strong positive rotary spring, and the hook member itself is formed adequantely along its top surface to provide rotary actuation when there is an upward pressure against the bottom of the rung. The entire assembly is mounted with strong bracketing providing housings for the axis and also providing compact space saving nesting adjacent to the siderails.

A very substantial advantage is that the normal position of the assembly during shipment or transportation is one of nesting in a ninety-degree (90°) turn position within the rungs and sections of the ladder without exposure when the ladder is being dragged or is being slided or otherwise handled in use.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
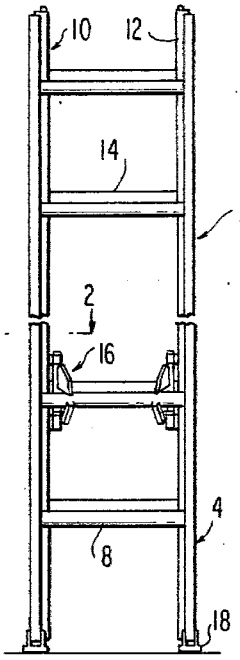
FIG. 1 is a fragmentary lateral view of an extension ladder equipped with rotary hook locks of the invention.

Referring in detail to the drawings in which identical parts are similarly numbered, the extension ladder 2 comprises a bed section 4 formed of a pair of parallel side rails 6 and step members 8 fixed transversely on the side rails 6. It also comprises a fly section 10 formed of first and second parallel sides rails 12, transverse step members 14 spaced apart equivalent to the spacing of the step members 8 and rotary automatic hook locks 16.

The bottom of the side rails 6 are provided with pivoted foot pads 18.

The hook locks 16 comprise a rotatable hook unit 20 having an elongated tubular portion 22, preferrably with a square cross-section, and a contoured hook portion 24 extending laterally from the portion 22. The hook portion has a triangular shaped outboard end 26, a free arcuate edge 28, a substantially straight edge 30 integral with the tubular portion 22 and a lower edge 32 extending laterally from the tubular portion 22.

The hook portion 24 is predominately a flat section, but there is a slot 34 in the top of edge 30 and this allows the arcuate edge 28 to be bent slightly out of the plane of the flat section. This bend provides a sliding surface for engagement with step members 8 as the fly section 10 is raised on the bed section 4.

A longitudinal shaft 36 is fixed spaced apart, and parallel to side rails 12 by brackets 38 that are fastened to the side rails 12 by rivets 40. Nuts 42 and 44 retain the shaft 36 in the bracket bearings 46. The lock unit 20 is rotatably positioned on the shaft 36 between the brackets 38 with washers 48 interposed.

If desired, the nut 42 may be replaced by a flat head (not shown) formed integrally on the end of the shaft 36.

A coil spring 50 having a hook end 52 and straight end 54 biases the hook unit toward its hooking position.

Figure 5:
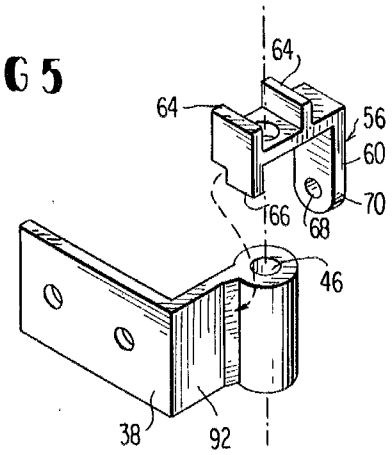
FIG. 5 is an exploded view of bracket and stop members of the new hook locks.
Figure 6:
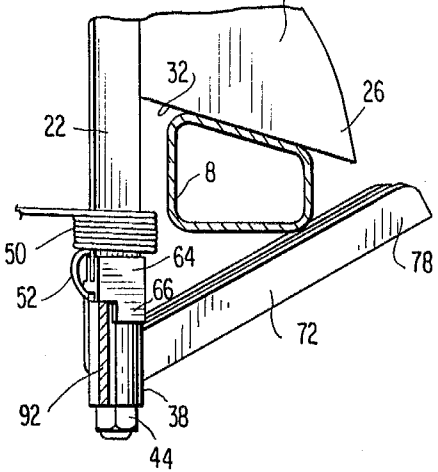
FIG. 6 is a fragmentary, sectional view taken on the line 6—6 of FIG. 3.

A stop member 56 (see FIG. 5) comprising a body portion 58 and a transverse leg portion 60 has a hole 62 in the body portion 60 which allows the member 56 to be positioned on shaft 36 between the lower end of hook unit 20 and the lower bracket 38. The stop member 56 has a pair of integral lugs 64 that extend transversely from the surface opposite to the leg 60 and a third lug 66 that depends from the lower side of the body portion 58. The leg portion 60 has a hole 68 in its free end 70.

An elongated toggle 72 is pivoted at its end 74 by rivet 76, to the leg portion 60 of stop member 56. The toggle 72 is long enough so its free end 78 can swing into contact with the end 26 of hook portion 24. Advantageously, the toggle 62 is a U-shape channel piece so that the hook end 26 will extend into the channel piece when toggle 72 contacts the ends 26 (see FIGS. 8 & 9).

A coil spring 80 is carried on rivet 76 and has one end 82 hooked through a hole 84 in the toggle 72 and its other end 86 hooked through a hole 87 in leg portion 60 of step member 56. The spring 80 biases the toggle 72 to move into contact with hook end 26.

The rotary hook locks are carried on the fly section 10 of ladder 2 so that the loci of the lower edges 32 of the hook portions 24 will lie substantially in the plane of the tread surface 88 of one of the step members 14 of the fly section 10.

The sequence of movements of the rotary hook locks 16 during extension of the ladder 2 is illustrated by FIGS. 4,7,8,9 and 10. The sequence of movements during retraction of the ladder 2 is illustrated by FIGS. 4,7,8 and 11.

Figure 2:
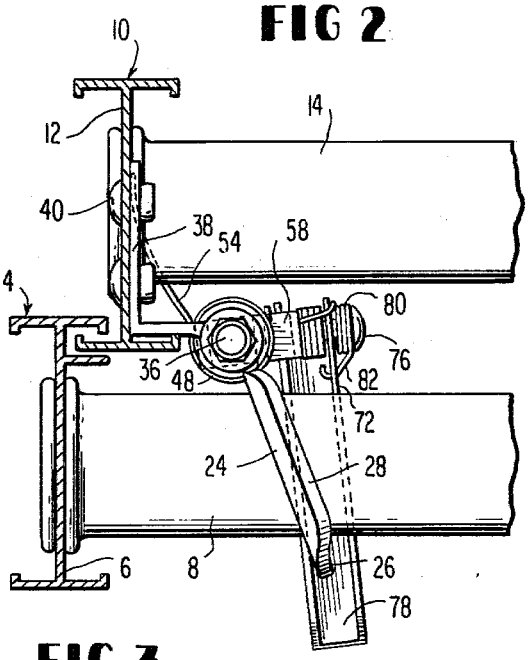
FIG. 2 is a fragmentary sectional view taken on the line 2—2 of FIG. 1.
Figure 4:
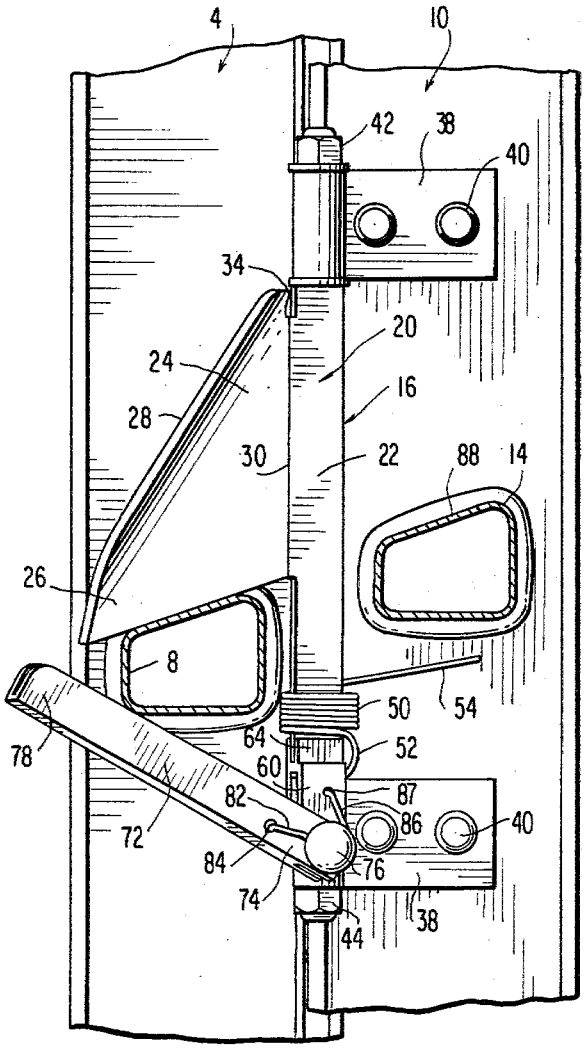
FIG. 4 is a fragmentary sectional view taken on the line 4—4 of FIG. 3.
Figure 3:
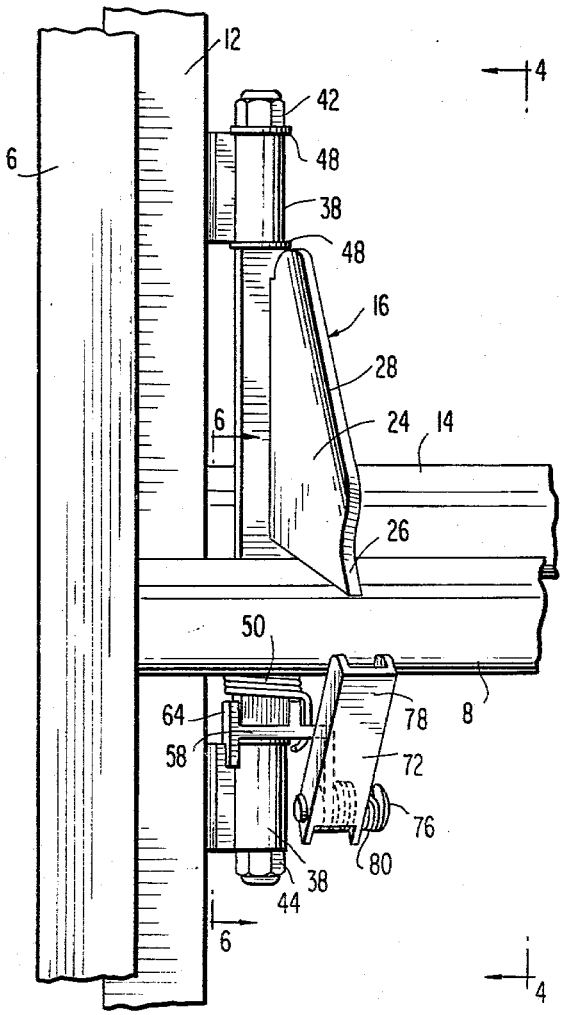
FIG. 3 is a fragmentary lateral view of a rotary hook lock of the invention in the locked position.
Figure 11:
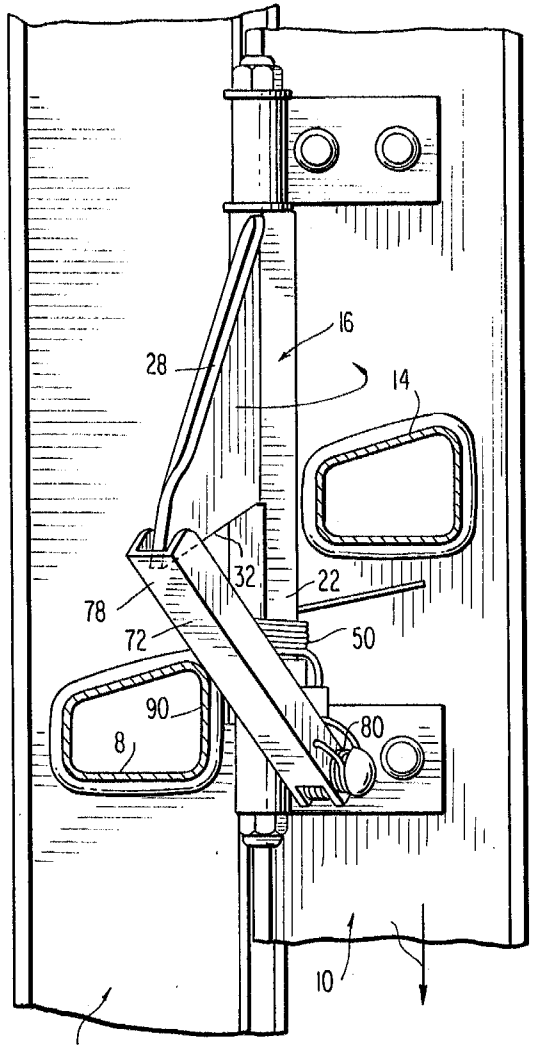
FIG. 11 is a fragmentary, sectional view showing how the rotary hook lock passes a ladder rung in the bed section as the ladder is retracted.
Figure 10:
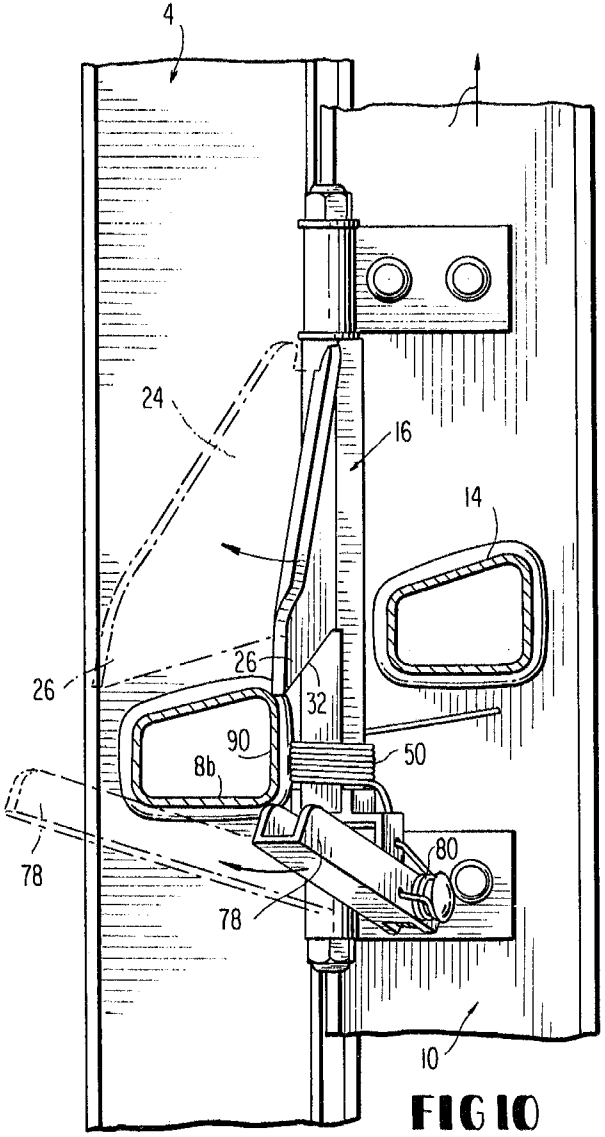
FIG. 10 is a fragmentary, sectional view showing the extension of the ladder as the rotary hook lock goes into the locking position.
Figures 7, 8, 9:
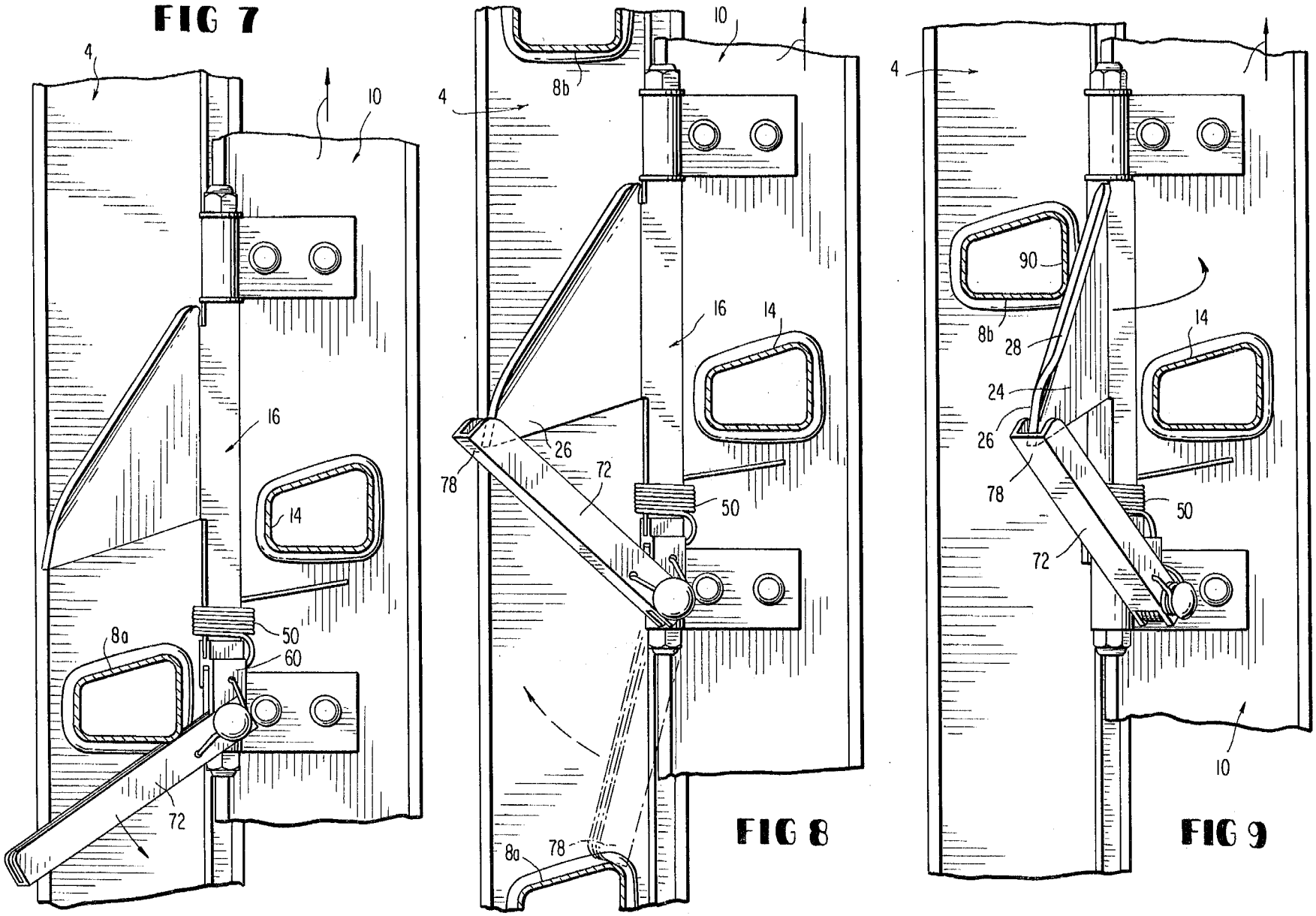
FIG. 7 is a fragmentary, sectional view similar to FIG. 4 showing the ladder being extended.
FIG. 8 is a fragmentary, sectional view showing the ladder being further extended.
FIG. 9 is a fragmentary, sectional view similar to FIG. 8 showing the ladder being further extended.

FIGS. 2,3, and 4 show the rotary hook locks in the locking position while FIGS. 9,10 and 11 show them in the passing position.

As the fly section 10 is raised relative to the bed section 4, the toggle is swung by the step member **8*a* in the direction of the arrow in FIG. 7. Continued extension of fly section 10 ultimately allows the toggle to slip past the step member 8*a* so that the toggle 72 is snapped in the direction of the arrow in FIG. 8 by the spring 80 so the toggle end 78 contacts the hook end 26**.

Still further extension of the fly section brings the bent edge 28 of hook portion 24 into contact with the next higher step member **8*b* of the bed section 4. This causes the hook unit 16 to be rotated against the pressure of spring 50 toward the passing position as shown by the arrow in FIG. 9. Continued upward movement causes the end 26 of hook portion 24 to slide along the back edge 90 of step 8*b* until it clears the step member 8*b*. As the sliding contact of hook end 26 with back edge 90 occurs, the end 78 of toggle 72 is disengaged from the hook end 26 because of interference with step member 8*b*. Hence, the toggle remains behind and below the step member 8*b*. When the hook portion 24 clears the step 8*b*, the spring 50 causes it to rotate in the direction of the top arrow in FIG. 10 and assume the locking position. At the same time, the toggle 72 also rotates in the direction of the bottom arrow in FIG. 10 to remain below the step member 8*b*. The lower edge 32 then will rest upon the tread surface of a step member 8 of the bed section 4 (see FIG. 4). Since the edge 32 is in line contact with the tread surface of step member 8, strong, safe support of the fly section 10 upon the bed section 4** is attained in an extended condition of the ladder.

As previously stated, the tubular portion 22 is preferrably of square cross section. The lugs 64 on step member 56 are spaced apart so they embrace the lower end of tubular portion 22 in the hook lock assembly. Hence, as the hook portion 20 rotates on shaft 36, the stop member is caused to rotate also because of the lugs 64.

The location of the hook lock 16 in the locking position is determined by the lug 66 on stop member 56. Thus, lug 66 limits the extent to which the spring 50 can rotate the hook lock 16 by contact of the lug 66 with web 92 of the lower bracket 38.

Retracting or lowering the ladder begins from the locking position as seen in FIG. 4. The fly section is then raised so the toggle 72 passes the bed section step member 8 (see FIG. 7) and snaps into contact with hook portion 24 (see FIG. 8). At this point the fly section is lowered. Continued lowering brings the toggle 72 into contact with a bed section step member 8. As the toggle 72 slides along the back edge 90 of the step member 8, it forces the hook lock 16 to rotate in the direction of the arrow in FIG. 11 and so the hook lock 16 can pass as many step members 8 of the bed section 4 in this manner as desired by the ladder user. To then return the hook locks 16 to a locked condition as seen in FIG. 4, the fly section is again raised through the steps shown in FIGS. 9 and 10.

While preferred structures have been shown and described for biasing and limiting rotation of the new rotary hook locks, it will be apparent that other means for accomplishing this and other functions while still utilizing the basic concepts and features of the invention.

From the foregoing description of the invention, it will be seen that it provides a new form of hook locks for extension ladders that provide strong, safe locking of the ladders in an extension condition and that they do this in an easy and convenient manner.

The embodiments of the invention in which an exclusive property or privilege is claimed are defined as follows:

1. In an extension ladder having a bed section formed of a pair of parallel side rails and a plurality of equally spaced apart step members fixed transversely upon the side rails and a fly section formed of first and second parallel side rails and a plurality of transverse step members fixed upon the side rails spaced apart equivalent to the spacing of the step members of said bed section, the improvement which comprises:

a pair of rotary automatic hook locks each comprising a rotatable hook unit having an elongated tubular portion with a contoured hook portion extending laterally therefrom, said hook portion having a triangular shaped outboard end, a longitudinal shaft fixed spaced apart from and parallel to a side rail of the ladder by a pair of brackets fastened to that side rail, said hook unit being rotatably positioned on said shaft between said brackets for rotation between a hooking position and a passing position, first spring means biasing said hook unit toward said hooking position, a stop member comprising a body portion and a transverse leg portion positioned on said shaft between one end of said hook unit and one of said brackets for rotation with said hook unit, an elongated toggle pivoted at one end upon said leg portion of said stop member, said toggle being long enough so the free-end thereof can swing into contact with said hook portion outboard end, and second spring means biasing said toggle into said outboard end contacting position.

2. The extension ladder of claim 1 wherein said contoured hook portion is defined by a substantially straight edge that is integral with said tubular portion, a lower edge extending laterally from said tubular portion and a free arcuate edge.

3. The extension ladder of claim 2 wherein said hook portion is predominately a flat section although said free arcuate edge bends out of the plane of said flat section to provide a sliding surface for engagement with step members of said ladder.

4. The extension ladder of claim 1 wherein said stop member includes a lateral lug that limits its rotation around said shaft by said first spring means through contact of said lateral lug with one of said brackets.

5. The extension ladder of claim 4 wherein said elongated tubular portion has a square cross-section and said stop member has integral protrusions that engage sides of said tubular portion thereby causing said stop member to rotate in unison with said tubular portion.

6. The extension ladder of claim 2 wherein said rotary automatic hook locks are carried on said fly section so that the loci of said lower edges of said contoured hook portions lie substantially in the plane of the tread surface of one of the step members of said fly section.

7. The extension ladder of claim 1 wherein said toggle is a U-shaped channel piece that is pivoted upon said stop member leg portion so that said hook portion outboard end will extend into the channel piece when the toggle contacts said outboard end.

* * * * *